US008168875B2

(12) United States Patent
Stockli

(10) Patent No.: US 8,168,875 B2
(45) Date of Patent: May 1, 2012

(54) DRUMSTICK WITH A LIGHT EMITTING DIODE AND METHOD FOR MANUFACTURING

(75) Inventor: Martin Stockli, Schenkon (CH)

(73) Assignee: Magic Sticks GmbH, Root Langenbold (CH)

( * ) Notice: Subject to any disclaimer, the term of this patent is extended or adjusted under 35 U.S.C. 154(b) by 49 days.

(21) Appl. No.: 12/933,779

(22) PCT Filed: Mar. 28, 2009

(86) PCT No.: PCT/EP2009/053700

§ 371 (c)(1),
(2), (4) Date: Sep. 21, 2010

(87) PCT Pub. No.: WO2009/121819

PCT Pub. Date: Oct. 8, 2009

(65) Prior Publication Data

US 2011/0017046 A1 Jan. 27, 2011

(30) Foreign Application Priority Data

Apr. 3, 2008 (EP) ..... 08154018

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS

| | | | | |
|---|---|---|---|---|
| 4,106,079 | A | 8/1978 | Drury | |
| 4,226,163 | A | 10/1980 | Welcomer | |
| 4,722,035 | A | 1/1988 | Rapisarda | |
| 6,423,891 | B1 | 7/2002 | Zengerle | |
| 6,479,737 | B1 | 11/2002 | Lebeda | |
| 7,687,700 | B1 * | 3/2010 | Torres | 84/422.4 |

OTHER PUBLICATIONS

International Search Report issued in International Application No. PCT/EP2009/053700 on Mar. 24, 2010 (with translation).

* cited by examiner

*Primary Examiner* — Kimberly Lockett
(74) *Attorney, Agent, or Firm* — Oliff & Berridge, PLC

(57) ABSTRACT

The drumstick provided for musical instruments such as drums and percussion instruments comprises a drumstick shaft and a drumstick head comprising an outlet opening from which the light of at least one light-emitting diode provided in the drumstick can exit. According to the invention, the drumstick comprises two shells that are complementary to one another and extend parallel to the longitudinal axis of the drumstick, said shells being glued together and preferably made of wood, at least the first shell of which comprising a notch within which a switching apparatus is disposed for controlling the light-emitting diode which is located in the drumstick head or which is located in the drumstick shaft and is connected to at least one fiber-optic cable that leads to the outlet opening of the drumstick head.

14 Claims, 6 Drawing Sheets

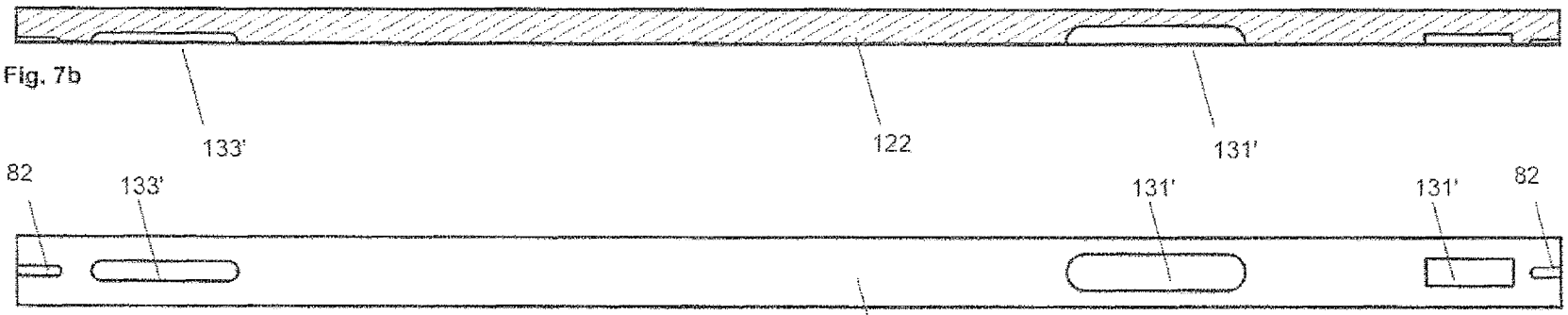
Fig. 7b
Fig. 7a
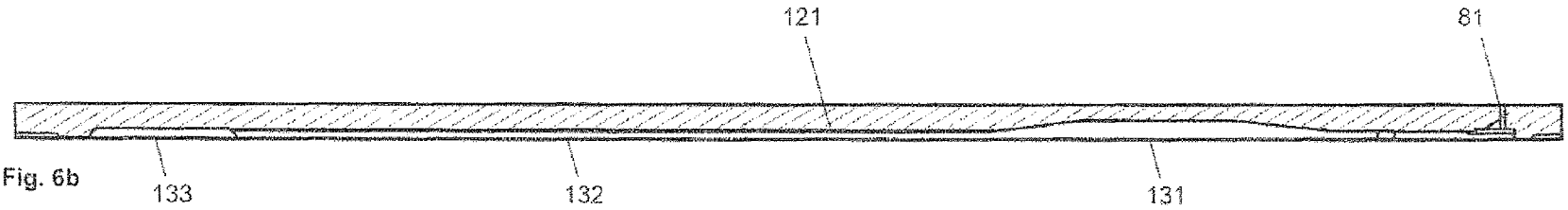
Fig. 6b
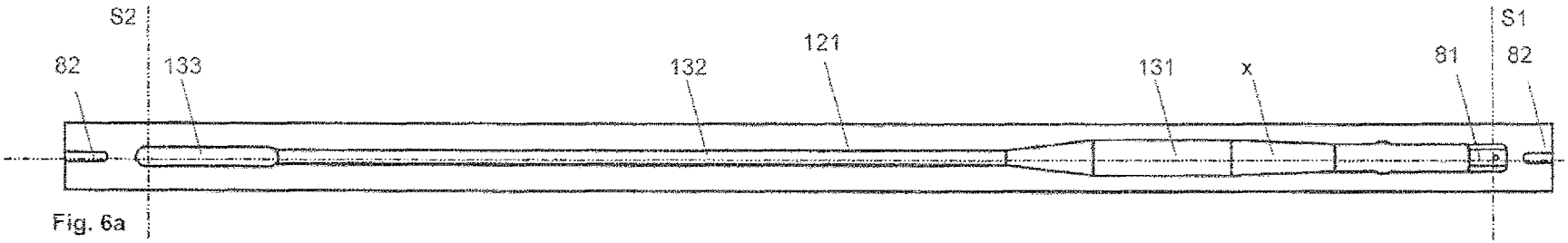
Fig. 6a
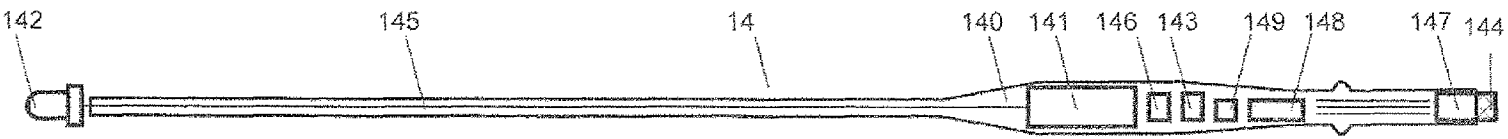
Fig. 5

DRUMSTICK WITH A LIGHT EMITTING DIODE AND METHOD FOR MANUFACTURING

The invention relates to a drumstick for a musical instrument that comprises at least one light emitting diode as well as to a method for manufacturing such a drumstick according to the preamble of claims 1 and 11 respectively.

Percussion instruments, like drums, timpani and drum kits, require drumstick, poles or rods.

From [1], U.S. Pat. No. 4,106,079, illuminated drumsticks are known, which are made of a transparent material and which have an inner chamber that serves for receiving a chemiluminescent material. A disadvantage of this solution is the need to produce the drumstick body from a transparent material such as, plastic. Particularly professional musicians however prefer drumsticks made of wood, which have significant better sound properties and further benefits. Hence, the solution disclosed in [1] is rather inappropriate for professional purposes.

[2], U.S. Pat. No. 4,226,163 describes a two-part drumstick with an attached drumstick head, which comprises a light emitting diode. This allows the shaft of the drumstick to be manufactured from any material such as wood, and be provided later with the separate drumstick head. However, the combination of the drumstick head and the drumstick shaft creates problems with respect to mechanical stress. In addition, this two-part drumstick differs in view of musical behavior and handling from conventional drumsticks.

[3], U.S. Pat. No. 6,423,891 B1, and [4], U.S. Pat. No. 4,722,035 A, describe further drumsticks, which comprise two mutually complementary shells, which are glued to one another and aligned in parallel to the longitudinal axis of the drumstick. These solutions comprise electrical circuitry consisting of separate components, which are pressed against one another by means of mechanical elements, such as a spring. This solution results in the disadvantage that the individual elements of the circuitry can start to move and to vibrate with their natural resonance. The behavior of such a drumstick is therefore not comparable with the behavior of conventional wooden drumsticks.

Further, as this is well illustrated in [3], for the connection of the light emitting diode connecting cables are required, which need to be connected on the one side with the light emitting diode and on the other side with the elements of the electrical circuitry. These connecting cables and the electrical contacts are exposed to a mechanical impact, when the drumstick is used, so that insufficient contacts and disconnections may occur.

Further, it can easily be seen that relatively high efforts and manual skills are required for establishing the electrical connections illustrated in [3]. An automated production of the solutions of [3] and [4] is therefore not possible.

The present invention is therefore based on the object of creating a drum stick with a light emitting diode for musical instruments, which is not afflicted with the above-described disadvantages.

In particular, a drum stick shall be created, which, in spite of the integration of a light emitting diode, does not differ in view of handling and sound quality from a drumstick, as it is used by professional musicians. Disturbing vibrations and resonances shall be avoided.

Furthermore, the new drumstick shall be of high quality and shall maintain the advantageous properties even after prolonged use.

The drumstick or parts thereof should be able to be created automatically in order to reduce manufacturing costs and to ensure a consistently high quality of the product.

Still further, a method for manufacturing the new drumstick shall be defined.

This problem is solved with a drumstick and a method for manufacturing this drumstick, which comprise the features specified in claim 1 or 11. Advantageous embodiments of the invention are defined in further claims.

The drumstick that is designed for musical instruments, such as drums and drum kits, comprises a drumstick shaft and a drumstick head with at least one outlet opening, which preferably is axially oriented to the front of the drumstick, and out of which outlet opening the light of at least one light emitting guided provided in the drum stick can exit.

The drumstick consists of at least two mutually complementary shells, that are aligned in parallel to the longitudinal axis of the drumstick and that are glued together. From these shells at least the first shell comprises a recess within which an electrical circuit is arranged, which serves for controlling the light emitting diode that is arranged in the drumstick head order that is arranged in the drumstick shaft and is connected to at least one optical fiber that is guided to the outlet opening in the drumstick head.

The electrical circuitry comprises a fixed or flexible printed circuit board, which extends across the drumstick shaft to the drumstick head.

This solution allows manufacturing the shells advantageously from a suitable timber. Through the use of two possibly identical wooden shells, which are aligned along the longitudinal axis of the drumstick and glued to one another preferably in a connection plane, a high stability of the drumstick is achieved, that corresponds to the stability of conventional solid-wood drumsticks. The recess in one or both of the wooden shells is relatively small, so that relatively large, preferably flat connecting surfaces remain on the wooden shells which are respectively can be glued to one another so stable, that both wooden shells practically form an entity.

The use of a fixed or flexible printed circuit board, which extends from the drumstick shaft to the drumstick head, comprises further significant advantages in view of manufacturing and quality of the product. The electrical circuit can completely be prefabricated on the circuit board and then be inserted in one step into the first wooden shell. Due to the optimal adaptation of the assembled printed circuit board to the recess the assembly can be done with minimal effort and high precision. Further, with the prefabrication, a high quality standard can be achieved. The circuit board can be manufactured and assembled in automated processes, enabling cost savings and quality improvements.

It is particularly advantageous to lead the printed circuit board to the drumstick head. A separate assembly of connecting cables is completely avoided. These cables are replaced by electric wires provided on the printed circuit board that can be produced without additional effort. The light emitting diode can therefore be directly connected to the wires of the printed circuit board, one of which wires is preferably located on the top and the other on the underside of the printed circuit board.

In a first embodiment the printed circuit board is provided with the light emitting diode in the region of the drumstick head, which is connected via connecting lines also provided on the printed circuit board with a power supply unit and, if appropriate, with electronic components, which are arranged in the grip area of the drumstick shaft. Particularly advantageous is the use of a rechargeable battery. At the end of the printed circuit board are preferably a connector and a switching element, preferably a control key, arranged.

In a further embodiment, the light emitting diode is mounted in the area of the drumstick shaft. In this embodiment, the light provided by the light emitting diode light is guided by a fiber optic cable to the outlet opening in the drumstick head. Particularly in this embodiment at least one additional optical fiber can advantageously be guided to the end of the drumstick that is opposite to the drumstick head. The light provided by the light emitting diode is therefore emitted at both ends of the drumstick. This is especially effective when the user rotates the drumstick, for example. Optical fibers can also be led to the sidewall of the drumstick.

Through the use of more than three shells, the acoustic properties and the strength of the drumstick can advantageously be changed. With the use of more than three shells results an increased stiffness of the drumstick, so that the timbre of the instrument will change accordingly. It is possible to use identical shells or shells that can attached to one another in a form-locking manner.

For manufacturing the drumstick at least the first, preferably still unprocessed wooden shell is provided with a recess, which is designed to receive the electrical circuit and the light emitting diode at least partially. The recess extends within the drumstick at least approximately axially, preferably from the drumstick head to the drumstick shaft. Due to the use of two wooden shells, the recesses can, adapted to the electrical circuit, precisely and exactly be worked into the wooden shells. An unnecessary weakening of the cross section of the drumstick is thereby avoided. Since the elements of the circuit arrangement lie in the region of the longitudinal axis of the drumstick, also the second wooden shell is preferably provided with one or more recesses, which serve for the partial inclusion of the larger components of the electrical circuit. Subsequently, the two wooden shells are glued together and pressed under high pressure of up to 50 tons.

Preferably, wooden shells are used that are not preprocessed and that are brought into the desired shape preferably by turning with a corresponding device but after the incorporation of the recesses and the mounting of the electrical circuit as well as casting and bonding. This allows manufacturing the first and second wooden shells in multiples from a wooden board. Therefore, the recesses of a plurality of wooden shells can be incorporated into the wooden board. The gluing of the wooden shells may be performed in such multiples or after the separation of the wooden shells. If identical wooden shells are used, the manufacturing cost is reduced accordingly.

Preferably, the parts of the recesses provided in the two wooden shells, after the electrical circuit has been inserted in one of the wooden shells, are filled with a polyurethane adhesive, before the wood shells are bonded. By this measure, the electrical circuit is optimally protected. Furthermore, hollow bodies, which affect the properties relevant for the sound, are closed. Furthermore, the drumstick obtains a weight and a high mechanical strength, as this is given by a solid-wood drumstick.

In a further process step, the surface of the light emitting diode serving for emitting light is freed from the adjacent adhesive, whereby the outlet opening of the drumstick head is filled with a transparent filling material, preferably epoxy resin.

The drumstick head preferably comprises a forward oriented conical outlet opening with an opening angle of 40°-60°, which is optionally provided with a reflective layer to improve the radiation properties.

The electrical circuit preferably comprises a control unit provided with a processor and a control program, which is connectable for example to a host computer via a connector, which is preferably located at the end of the drumstick shaft, and an electrical cable or via a radio interface. The drumstick can therefore exchange data with the host computer. For example, operating data, particularly the status of the drumstick or signals captured by sensors, such as the stroke rhythm, can be transferred to the host computer.

From the host computer, however, operating programs or concurrent instructions can be transferred to the control unit. For example, the colors provided by the drumstick can be synchronized with the color changes of the room lighting. If a musician plays a solo, the light emitting diode can be operated with maximum power and, if appropriate, with a desired color sequence.

Preferably the control unit is used to control the light emitting diode in at least one mode of operation. The control unit can dictate a beat, which is optically signaled by the drumstick. For example, the beat can be selected by means of the at least one control key or can be dictated by the host computer via radio signals.

In a further mode of operation, the signals captured by an acceleration sensor are transferable to the host computer, which uses these signals for example for controlling acoustical or optical modules.

The most important modes of operation allow the drumstick however, to emit light or individual colors continuously, intermittently, or according to the selected program flow.

The power supply unit preferably consists of a lithium-ion battery that is galvanically or inductively charged by a charging device. Preferably the charging device is connected to a connector provided at the end of the drumstick shaft. Preferably, a mini- or micro-USB connector is used, over which the data transfer and the provision of electrical power can be handled by the host computer. The host computer can be a conventional personal computer, for example, a notebook.

If a completely autonomous operation is required, preferably a micro-electro-mechanical generator (MEMS) is used, which for example consists of coils and at least one magnet that is preferably deflected perpendicularly to the axis of the drumstick. With each stroke vibrations that are captured by the magnet are transformed into electrical energy. In the event that two generators are provided, the directions of motion of the magnets are preferably perpendicular to one another. By these measure it is assured, that always at least one generator provides electrical energy. By using micro-electro-mechanical generators it is particularly advantages that these generators can absorb undesirable vibrations of the drumstick, thus relieving the hand of the musician.

In further embodiments, the inventive drumstick can be provided with enforcing elements in the region of the drumstick head and/or with optical components, for example lenses.

Below the invention is explained in detail with reference to the drawings. Thereby shows:

FIG. 1 a section through an inventive drumstick 1, which comprises a circuit 14 provided in a recess 13, which, in the region of the drumstick shaft 12, is provided with circuitry 141 and in the drumstick head 11 with a light emitting diode 142;

FIG. 2 the drumstick head 11 and a part of the drumstick shaft 12 of the drumstick 1 shown in FIG. 1;

FIG. 3 a part of the drumstick shaft 12 of an inventive drumstick 1, which is provided with a micro-electromechanical generator and can autonomously be operated;

FIG. 4*a-d* different embodiments of the front side of the inventive drumstick 1;

FIG. 5 the circuit 14 of FIG. 1, which is implemented on a flexible printed circuit board 140, that extends almost over the whole length of the drumstick 1;

FIG. 6*a-b* different views of a first wooden shell 121, that is provided with a recess 13, into which the circuit 14 shown in FIG. 5 can be inserted;

FIG. 7*a-b* different views of a second wooden shell 122, which is complementary to the first wooden shell 121 and which is provided with recesses, into which the larger components of the circuit 14 can extend;

FIG. 8 the first multiple of shells 1210 manufactured from a wooden board with a plurality of wooden shells 121 that are not yet separated from one another;

FIG. 9 a second multiple of shells 1220 manufactured from a wooden board with a plurality of wooden shells 122 that are not yet separated from one another;

FIG. 10*a-c* further circuitries $\mathbf{14}_{A1}$, $\mathbf{14}_{A2}$, that are implemented on a flexible printed circuit board 140 and that are provided in the region of the power supply unit 141 with a light emitting diode 142, which is coupled with at least one optical fiber 1420;

FIG. 11 the first multiple of shells 1210 of FIG. 8 with a plurality of wooden shells 121 that are not yet separated from one another, and that are provided each with a circuit $\mathbf{14}_{A1}$ according to FIG. 10*a;*

FIG. 12 the drumstick head 11 of the drumstick 1 shown in FIG. 1;

FIG. 13 the drumstick head 11 of an inventive drumstick 1, into which an optical fiber 1420 is guided;

FIG. 14 the end of the drumstick shaft 12 of an inventive drumstick 1 that is closed with a closing element 19; and FIG. 15 inventive drumsticks 1, that can exchange data with the host computer 2 via electrical cables 3 or radio interfaces 143.

FIG. 1 shows a section through an inventive drumstick 1 that is provided with a circuit 14 arranged in a recess 13.

The recess 13 runs along the whole drumstick 1 and comprises an extended first recess part 131 at the end of the drumstick shaft 12, a channel-like second recess part 132 that leads to the drumstick head 11 and a third recess part 133 provided in the drumstick head 11. The circuitry 14 is preferably implemented on a flexible printed circuit board 140, whose dimensions and component placement are adapted to the mentioned recess parts 131, 132, 133. The printed circuit board 140 is provided within the first recess part 131 with a control key 144, with circuit components 141, . . . , if appropriate, a network module 143 and sensors 149, and with a power supply unit 141, within the second recess part 132 with connecting wires 145 and in the third recess part 133 with a light emitting diode 142.

The circuit components optionally provided on the printed circuit board 140 can fulfill different functions. In simple embodiments only the voltage transducer is provided that transforms the voltage received from the power supply unit 141. In preferred embodiments however a programmable processing unit is provided, with which an intelligent operation of the drumstick 1, preferably with a plurality of operation modes, can be realized. Further, sensors, particularly an acceleration sensor 149, micro-electromechanical generators 148 and wired or wireless network modules 143, particularly Bluetooth-modules or ZigBEE-modules, can be integrated into the circuit 14.

The control unit 146 can be realized with a microprocessor, PIC, FPGA or a proprietary ASIC. A PIC is a single chip micro-controller; an FPGA is a programmable integrated circuit (IC) of the digital technology. The English acronym FPGA stands for Field Programmable Gate Array and can be interpreted as "Logic module that can be modified ad-hoc".

The operational behavior is implemented for example with Assembler or one of the programming languages Java, C++. Further, with this technology, unlimited advantageous modes of operation and functions can be realized with little effort, which are selected by means of the control key 144 or by means of radio signals received from the host computer 2 (see FIG. 14). For example is possible, to control one or more light emitting diodes 142, particularly multi-colored light emitting diodes 142, as desired, in order to select the emission of light with a desired intensity, color and duration. The control key 144 can be a simple switching contact, a slide switch or a rotary switch.

FIG. 2 shows the drumstick head 11 and the part of the drumstick shaft 12 of the drumstick 1 of FIG. 1. It is shown, that the outlet opening 111, which is conically machined into the drumstick head 11, is filled with a transparent filling material 153, which encloses the light emitting diode 142 and is formed in such a way that the drumstick head 11 has a conventional form, for example the form of a sphere or an ellipsoid.

FIG. 3 shows a part of the drumstick shaft 12 of an inventive drumstick 1, which is provided with a micro-electromechanical generator 148 and therefore can be operated autonomously. Alternatively, the circuit 14 can also be provided with coils, into which a charging current can be induced. The communication with the host computer 2 is enabled for example by means of a Bluetooth- or ZigBEE-module 143. Therefore, an opening that provides access to the circuit 14 is only provided as an option.

FIG. 4*a-d* show sections of the front sides of further preferred embodiments of the inventive drumstick 1. FIG. 4*a* shows a drum stick head 11, in which an optical element, e.g. a lens 155, is provided that bundles the radiation emitted by the light emitting diode 143.

FIG. 4*b* shows the front side of a drumstick 1, in which the first part 131 of the recess 13 directly adjoins the drumstick head 11. In this manner the electrical and electronic components 141, . . . , can be arranged close to each other. However, a higher weight results in the region of the drumstick head 11, which is rather undesirable.

FIG. 4*c* shows the drumstick 1 of FIG. 4*b* after the recess 13 has been filled 13 with a polyurethane adhesive 151 and the outlet opening 111 of the drumstick head 11 has been filled with a transparent resin 153.

FIG. 4*d* shows the drumstick 1 of FIG. 4*b*, whose circuit has been provided with an additional light emitting diode 1422 in the first part 131 of the recess 13, whose light can escape through exit openings 129 provided in the side wall of the drumstick shaft 12. The drumstick 1 may therefore emit light not only frontally but also laterally. The light emitted by the two light emitting diodes 142, 1422 is preferably individually controllable. The exit openings 129 are preferably filled with the same transparent resin 153, as it is used for the outlet opening 111 of the drumstick head 11.

Inventive drumsticks 1, as they have been described above by way of example with reference to FIGS. 1 to 4 consist of two wooden shells 121, 122, that are complementary to one another, aligned in parallel to the longitudinal axis of the drumstick 1 and bonded to one another, and from which at least the first wooden shell 121 comprises a recess 13; 131', 133', within which the circuit 14 with the light emitting diode 142 is arranged. In the embodiment shown in FIGS. 1 to 4, the light emitting diode 142 is located in the drumstick head 11. However, the light emitting diode 142 can also be arranged in the first part 131 of the recess 13 and, e.g. be coupled with an optical fiber 1420 (see FIGS. 10 and 11), which is guided to the outlet opening 111 in the drumstick head 11.

FIG. 5 shows the circuit 14 of FIG. 1, which is implemented on a flexible printed circuit board 140, which extends over the whole length of the drumstick 1. On the printed circuit board 140, the power supply unit 141, a Bluetooth-module 143, a processor 146, a micro-electromechanical generator 148 and an acceleration sensor 149 are arranged. At the front sided end of the printed circuit board 140 the light emitting diode 142 is attached to connecting wires 145. On the back sided end of the printed circuit board 140, a control key 144 and a mini-USB-connector 147 are provided. The complete circuit 14 shown can therefore in its entirety be produced with efficient manufacturing processes and then be inserted in one of the wooden shells 121.

FIGS. 6 and 7 show first and second only partially processed wooden shells 121 and 122. FIG. 6*a* shows, seen from above, a first wooden shell 121 with the adjoining parts 131, 132, 133 of the recess 13 that is already machined into the first wooden shell 121, e.g. cut by means of a CNC-controlled machine. Further provided are auxiliary bores 81 and 82. The auxiliary bores 82 provided on both sides along the axis of the drumstick 1, allow to mount the wooden shells 121, 122, which are assembled and connected with one another, in a turning device. After the wooden shells 121, 122 have been provided with a desired form, the ends with the auxiliary bores 82 are cut off. In order to precisely apply the required cuts S1 and S2, the auxiliary bore 81 is used as a reference point.

FIG. 6*b* shows a longitudinal section along the first wooden shell 121.

FIG. 7*a* shows, from above, a second wooden shell 122 that is complementary to the first wooden shell 121. Into the second partially processed wooden shell 122 recesses 131', 133' have been machined, which are designed to partially receive the components of the circuit 14, particularly the light emitting diode 142, the power supply unit 141 and the connector 147.

The form of the recess 13 and the circuit 14 are adapted to one another. In principle it is possible to use identical first and second wooden shells. This is particularly then possible, when larger recesses are provided, which subsequently are filled with some more filling material 15. In the event that different embodiments of recesses 13 are provided in both wooden shells 121, 122, it is possible to adapt them optimally to the circuit 14. Hence, symmetrical and asymmetrical wooden shells can advantageously be used.

FIG. 7*b* shows a longitudinal section a long the second wooden shell 122.

Figure 1:
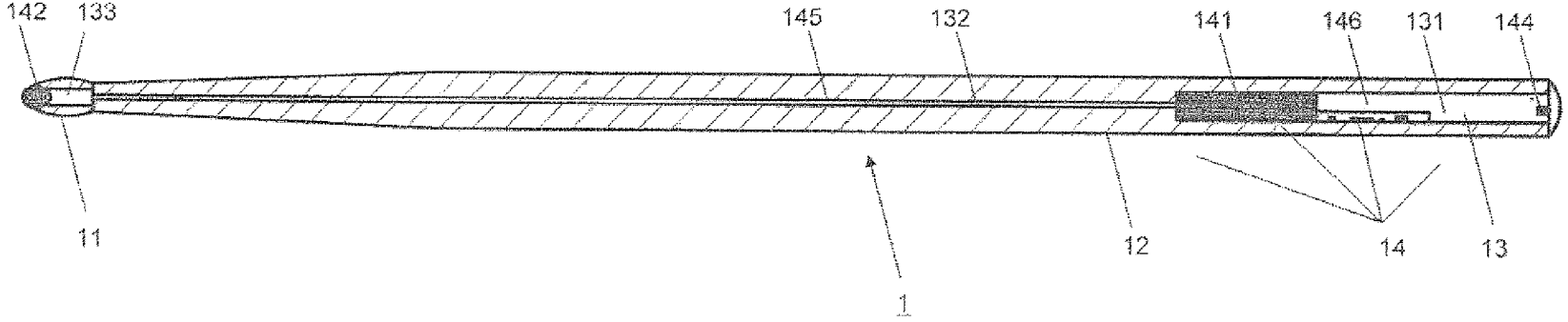
Figure 2:
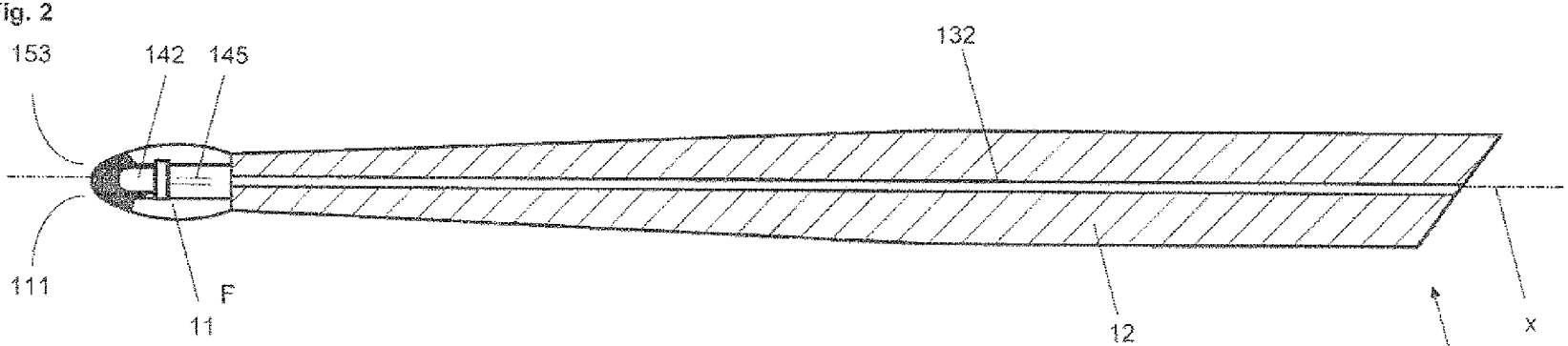
Figure 3:
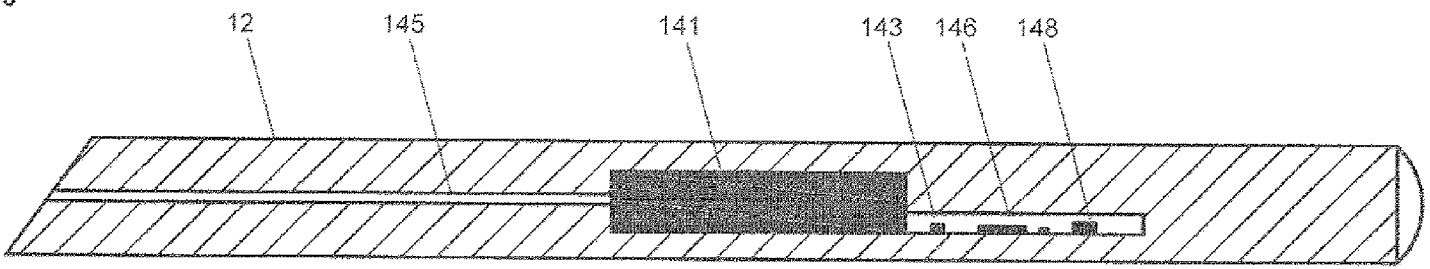
Figure 4A:
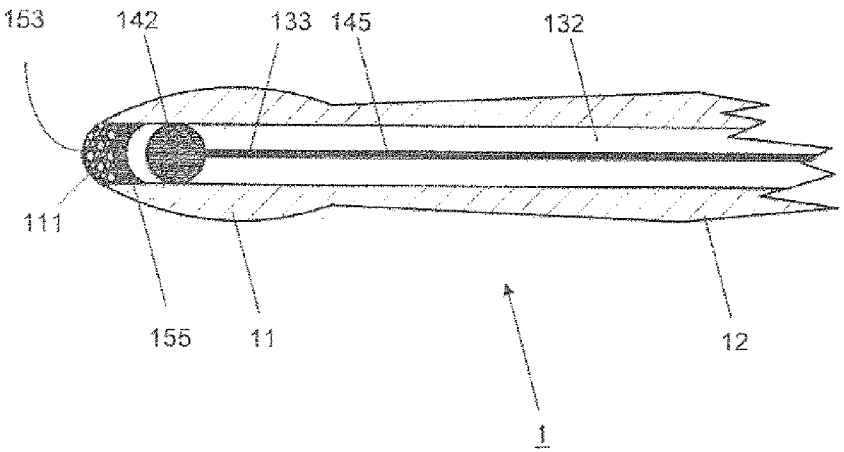
Figure 4D:
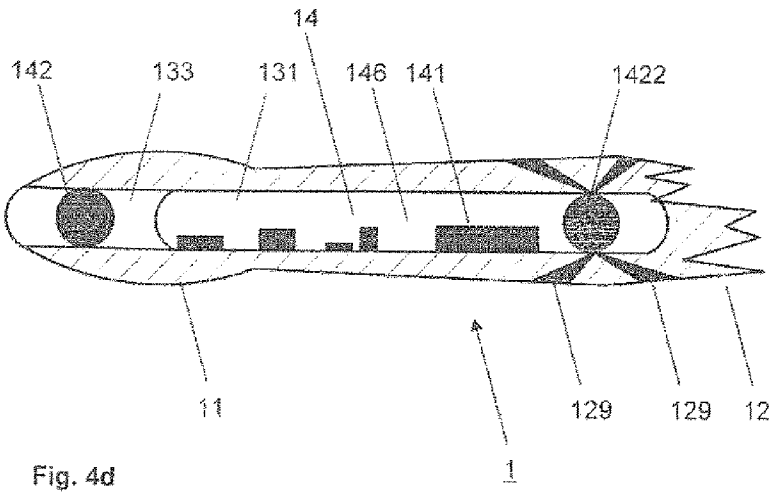
Figure 4B:
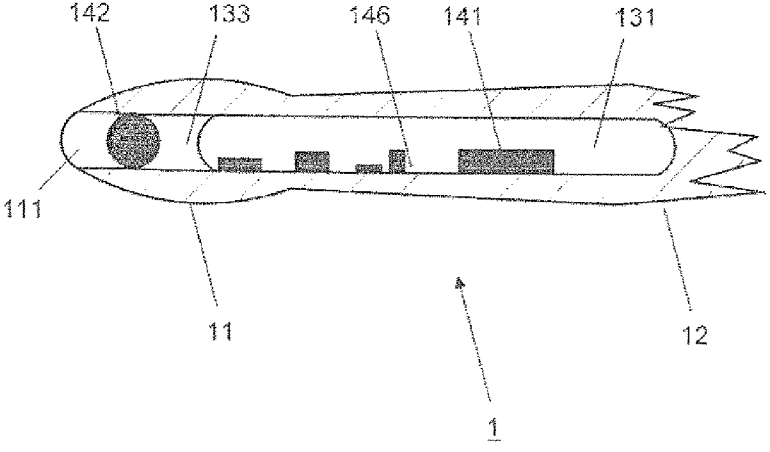
Figure 4C:
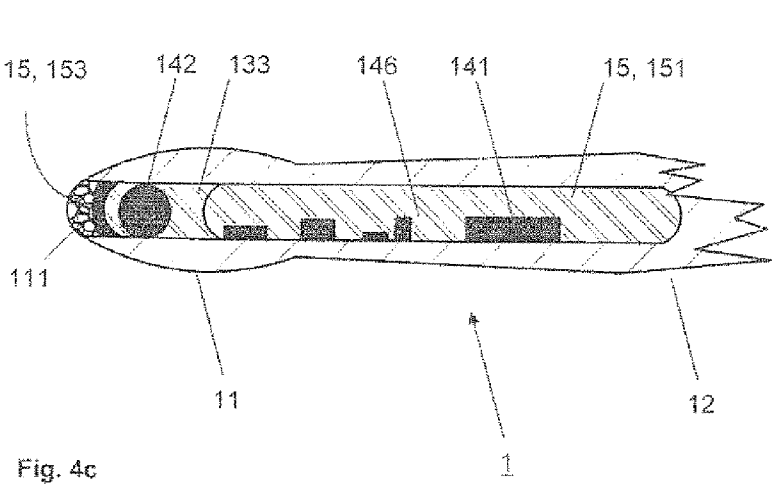

By using multiples of wooden shells in the manufacturing processes, the wooden shells 121, 122 can be preprocessed with minimal manufacturing efforts and subsequently be separated from one another. At the same time the wooden material can efficiently be used. Inserting and molding of the circuits 14, as described above, can be done before or after the separation of the first wooden shells 121.

Molding the circuit 14 with the components 141, 142, . . . , provided thereon serves for different functions. The circuit 14 is firmly held by the filling compound 15, so that no vibrations can occur, which could disconnect contact points for example. Further, disturbing vibrations are absorbed or significantly damped by the elastic filling compound 15. Further, the filling compound 15 preferably fills the machined recesses 13, 131, . . . , completely, so that no hollow bodies or resonant bodies remain. At the same time, the filling compound 15 provides the drumstick 1 with a high mechanical stability, which does not differ from the stability of a solid-wood drumstick.

Preferably the individual parts 131, 132, 133 of the recess are filled with different filling compounds 15, preferably with 2-component adhesives. For the attachment of the electrical components in the first part 131 of the recess 13, preferably polyurethane adhesive 151 is used with a thixotropic viscosity. For the second section 132 of the recess 13 preferably a polyurethane adhesive 152 preferably with a viscosity of 11,000 mPa·s (Brookfield 5/20) is used at 20° C. By using this slightly swelling adhesive 152 the thin conductors 145 that may be arranged on the printed circuit board 140 or the optical fiber 1420 arranged in the channel-shaped second part 132 of the recess 13 are firmly held. As mentioned above, the outlet opening 111 in the drumstick head 11 is filled with a transparent resin 153.

Figures 10A, 10B, 10C, 11:
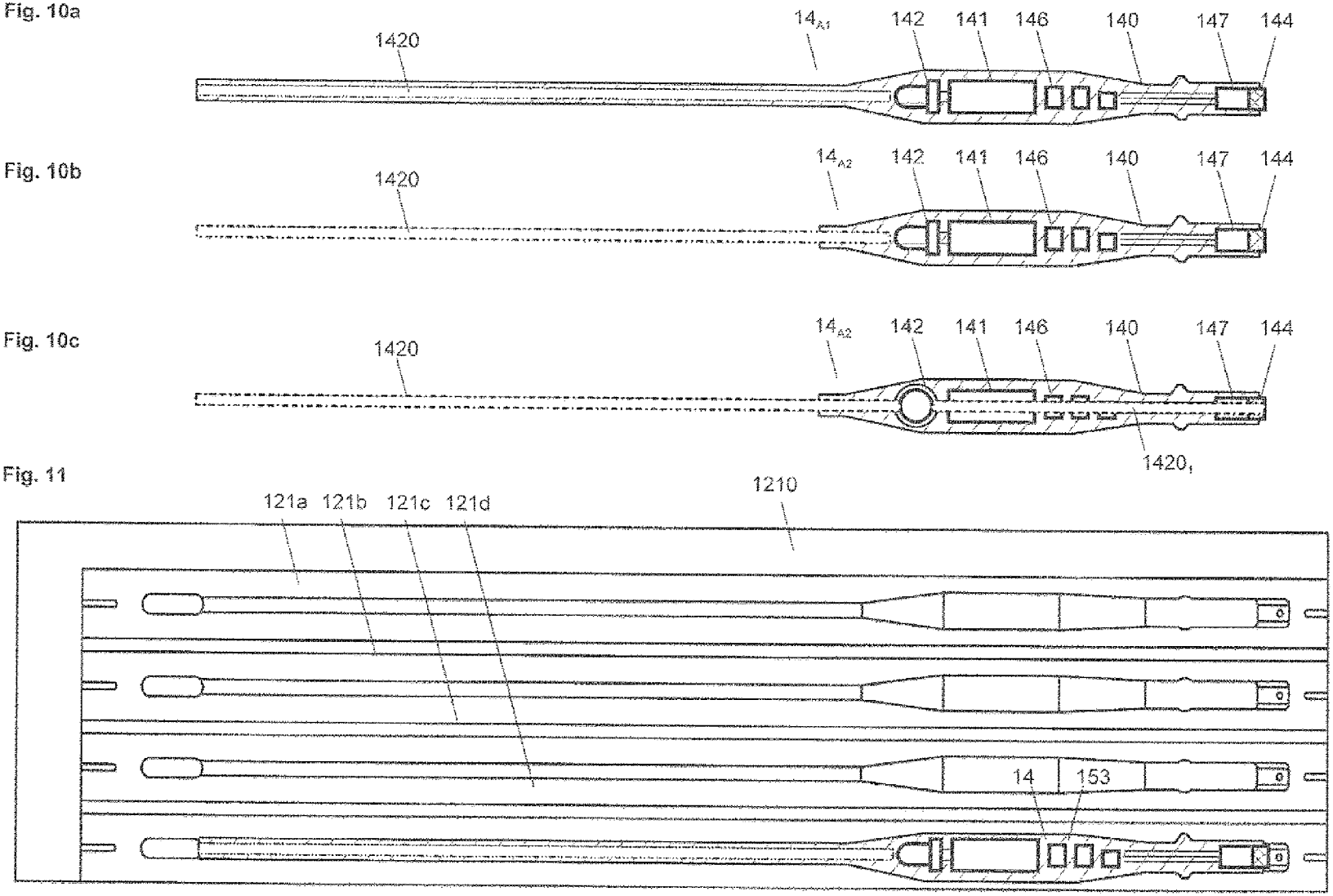

FIG. 10*a-b* show further circuits $\mathbf{14}_{A1}$, $\mathbf{14}_{A2}$, which are implemented on a flexible printed circuit board 140 and, in the region of the power supply unit 141, are provided with a light emitting diode 142, which is coupled with at least one optical fiber 1420.

Figure 14:
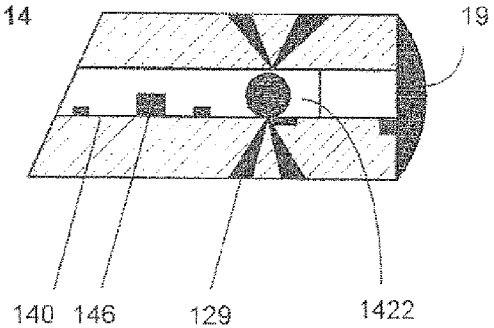

In FIG. 10*a* the optical fiber 1420 is fastened on the printed circuit board 140. In FIG. 10*b* merely the light emitting diode 142 is arranged on the printed circuit board, while the major part of the optical fiber 1422 is free it needs therefore to be handled with great care and needs to be precisely aligned. FIG. 10*c* shows an LED-Chip 142 that is mounted on the printed circuit board 140 to which two optical fibers 1420 and $\mathbf{1420}_1$ adjoin that forward the light emitted by the LED-Chip 142 to an exit opening 111 provided on one end each of the drumstick 1. For this purpose the drumstick 1 is, at the end opposite the drumstick head 11, provided with an exit opening 1111, out of which the light guided in the second optical fiber $\mathbf{1420}_1$ can exit. As shown in FIG. 14, the drum stick 1 may also comprise lateral exit openings 129, to which further optical fibers $\mathbf{1420}_1$ can be guided. For example, at the opposing ends of the drumstick 1 light with different colors can be emitted. It is further possible that the light emitting diode 142 is sitting on one end of the drumstick 1 in an exit opening 111 resp. 1111 and the optical fiber 1420 is guided to the exit opening 1111 resp. 111 at the other end of the drumstick.

Figure 8:
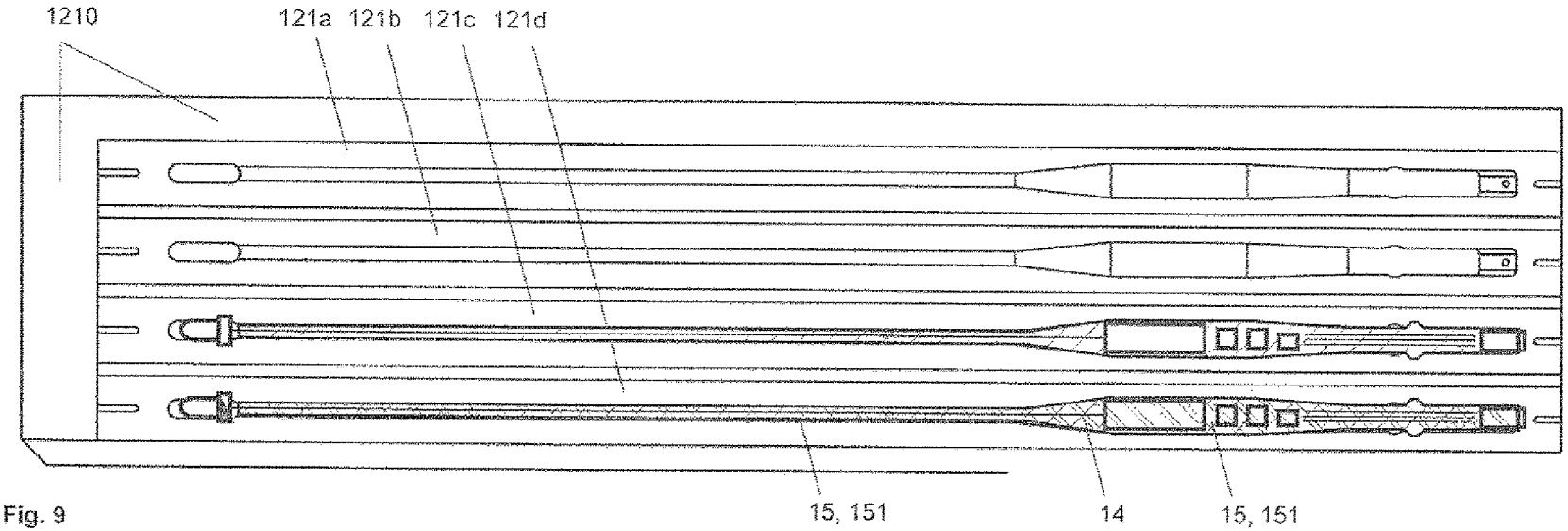
FIG. 8 shows a first multiple of shells 1210 manufactured from a wooden board with a plurality of first wooden shells 121 according to FIG. 6, that are not yet separated and in which two circuits 14 have been inserted.
Figure 9:
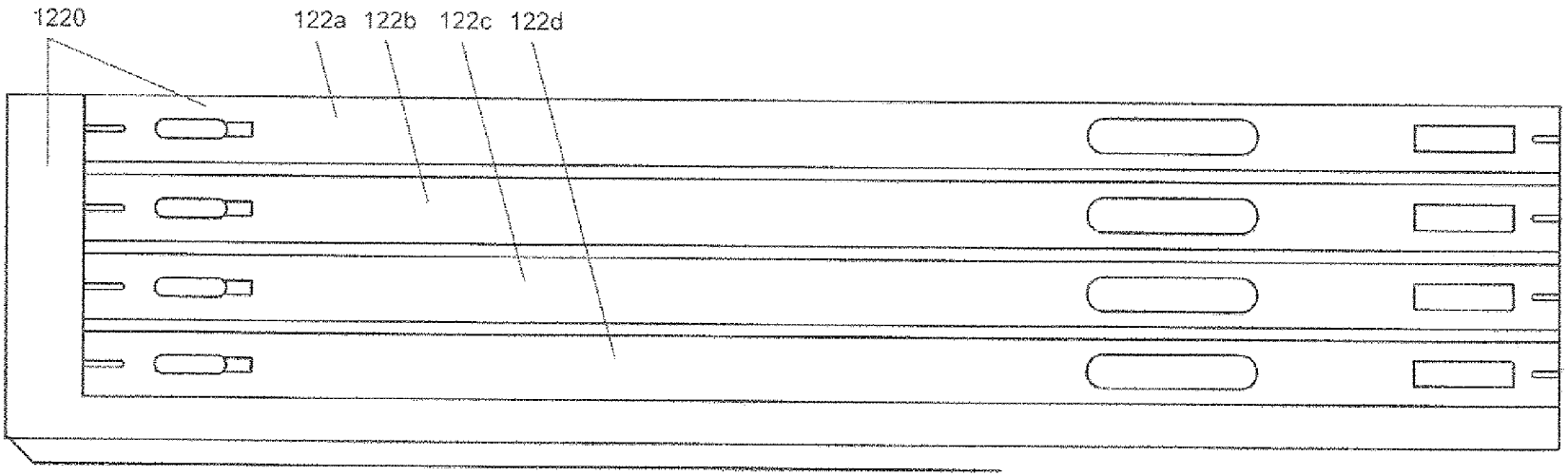
FIG. 9 shows a second multiple of shells 1220 with a plurality of second wooden shells 122 that are not yet separated from one another.

FIG. 11 shows the first multiple of shells 1210 of FIG. 8 with a plurality of wooden shells 121 that are not yet separated from one another, and from which one is provided with a circuit $\mathbf{14}_{A1}$ according to FIG. 10*a*. Preferably the optical fiber 1420 and the light emitting diode 142 are coupled with one another before they are inserted into the first wooden shell 121.

Figure 12:
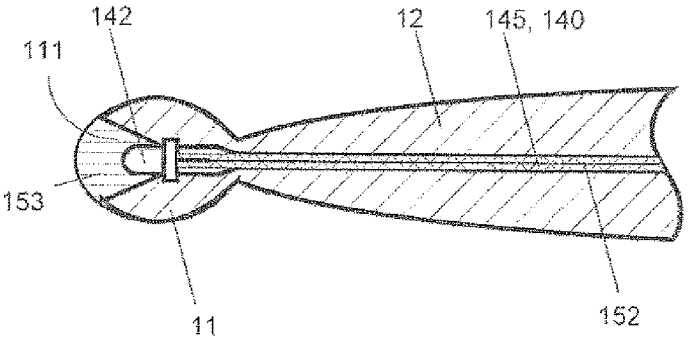

FIG. 12 shows the head 11 of the drumstick 1 of FIG. 1, which comprises a conical outlet opening 111 with an opening angle of 40° to 60°. Thus, the light can be emitted with a larger angle. The outlet opening 111 simultaneously serves as a reflector and is therefore accordingly be coated, e.g. with a metal film or metal varnish.

Figure 13:
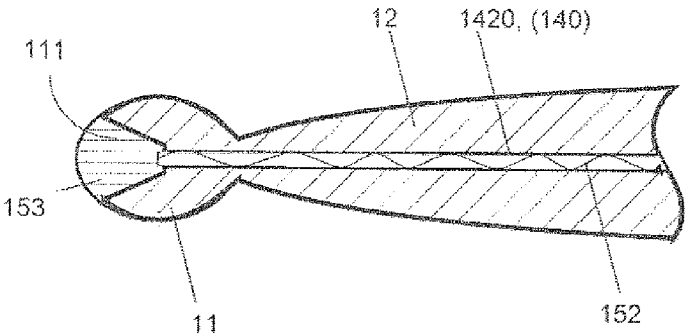

FIG. 13 shows the drumstick head 11 of an inventive drumstick 1, into which the optical fiber 1420 of the circuit $\mathbf{14}_{A2}$ of FIG. 10*b* is introduced.

FIG. 14 shows the end of the shaft 12 of an inventive drumstick 1 that is closed with a closing element 19. In preferred embodiments it is foreseen that the circuit 14 or parts therefrom, e.g. the power supply unit 141, if appropriate a high-power battery, can be removed and replaced. In view of the high quality the inventive drumstick 1 can also be firmly closed, so that no exchange of components is possible.

Figure 15:
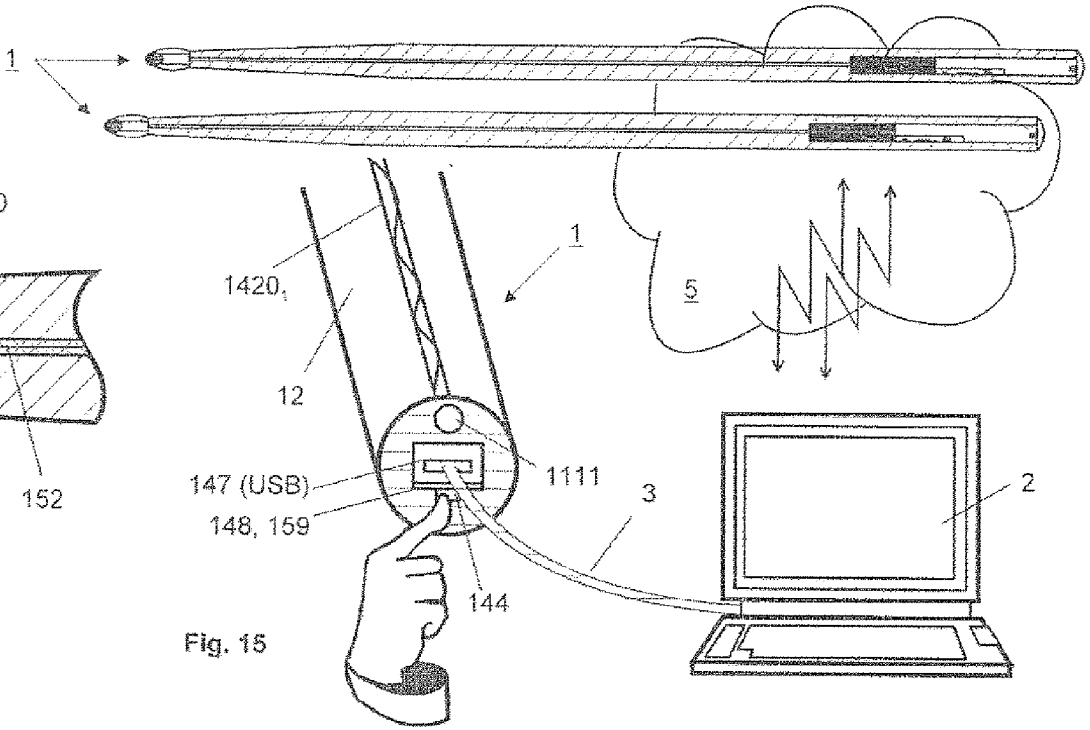

FIG. 15 shows inventive drumsticks 1, which are connectable via electrical cables 3 or radio interfaces 143 e.g. with a host computer 2, in order to exchange data or to a recharge the power supply unit 141.

The wireless communication is preferably done with network components, with which an ad-hoc network 5 can be established. An ad-hoc network is a radio network, which combines two or more terminals (one or more drumsticks 1, if appropriate the host computer 2) to an interconnected network. Inventive drumsticks 1 that have been taken into operation constitute therefore, preferably together with the host computer 2, such an ad-hoc network 5, as it is symbolically shown in FIG. 15.

An ad-hoc network can also be constituted exclusively by the drumsticks 1 of a group of drummers. Preferably, particularly on public events, a host computer 2 is provided. After the setup of the ad-hoc network e.g. a procedure for the synchronizations of the drummers can be performed. The synchronization is preferably performed by means of a light emitting diode 1422, which emit light with reduced intensity through a lateral opening 129 of the drumstick 1 that is observed by the drummer. Thereby it is possible, that drummers can be synchronized in the dark, without using acoustical signals and avoiding that spectators resp. listeners can see the optical signals, which exit through the openings 129. For this purpose it is also possible to use a plurality of colored light emitting diodes or to use multi-colored light emitting diodes and to control them with agreed synchronization frequencies. Thereby it is foreseen that an entity of the ad-hoc network, e.g. the host computer 2 or one of the drumsticks 1, serves as master, which can release command sequences. Such ad-hoc networks can for example be implemented with Bluetooth-technology or with ZigBEE-technology.

Further, the drumstick 1 shown in FIG. 15 is connected by means of a connecting cable 3 to the host computer 2 or to a charging device. The connecting cable 3 is connected to a connector 147 provided on the drumstick 1, e.g. to a mini-USE-connector, which is attached to the printed circuit board 140. On the other side of the printed circuit board 140 the control key 144 is provided. Further, as shown in FIG. 14, a cover 19 can be provided, which protects the mentioned elements.

The above described invention can be adapted by a person skilled in the art in various ways to individual requirements of the operator. The circuit can be enhanced with further components that fulfill further advantages new functions. The mentioned electrical and electronic components can be applied selectively as required by the operator. E.g., only the power supply unit 141 and the generator 148 may be provided. Different light emitting diodes can be used. LED-chips with or without a housing can be used. Furthermore, new adhesives and resins can be used, that have improved properties. Furthermore, optical auxiliary material of any kind can be used or mechanical elements can be used, which allow enforcing the drumstick 1 e.g. in the region of the recesses 13, 131, . . . .

It has been found that the use of elastic elements 159 is particularly advantageous, which hold components, e.g. the control key 144 or the connector 147 (see FIG. 14), even then in place, when strain occurs in the material of the drumstick.

The present solution is preferably realized with wooden shells. However, it is possible, that plastic materials will be found, which have comparable properties. It is therefore possible as well, that the shells are made from plastic.

The wooden shells are preferably made from Hickory-, Maple-, Birch-, Hornbeam-, Ramin- or Tonkin-wood or from further hard-wood material. As shown in the figures, both shells extend preferably over the whole length of the drumstick 1. The bent, stepped, but preferably plane geometrical intersection, over both shells, can however laterally be shifted or even be inclined with respect to the axis x of the drumstick, so that the drumstick head 11, if appropriate, belongs completely to one of the shells 111, 112.

List of References

[1] U.S. Pat. No. 4,106,079 A
[2] U.S. Pat. No. 4,226,163 A
[3] U.S. Pat. No. 6,423,891 B1
[4] U.S. Pat. No. 4,722,035 A

The invention claimed is:

1. Drumstick for musical instruments, such as drums and drum kits, comprising a drumstick shaft and a drumstick head provided with an outlet opening, out of which the light of at least one light emitting diode provided in the drumstick can escape, wherein the drumstick comprises at least two shells that are complementary to one another, aligned in parallel to the longitudinal axis of the drumstick and glued to one another, at least one of the shells comprising a recess, in which a circuit is arranged, that serves for controlling the light emitting diode, which is located in the drumstick head or which is located in the drumstick shaft and coupled with at least one optical fiber that is guided to the outlet opening, wherein the circuit comprises a fixed or flexible printed circuit board, which extends from the drumstick shaft to the drumstick head.

2. Drumstick according to claim 1, wherein the two, three, four or five shells, which are complementary together and which are combined to the body of the drumstick, are made from wood or from a plastic, and that the recess, in which the circuit and the light emitting diode are received at least partially, axially extends along the drumstick from the drumstick head to the end of the drumstick shaft.

3. Drumstick according to claim 1, wherein the recesses provided in the identically or asymmetrically designed shells are filled with a filling material, such as resin or adhesive, which is at least in the region of the drumstick head transparent, which is opened towards the outside.

4. Drumstick according to claim 1, wherein the printed circuit board, which extends over the whole drumstick shaft up to the drumstick head, to which in the region of the drumstick head the light emitting diode is connected;

or that the printed circuit board, which extends over the whole drumstick shaft up to the drumstick head, is in the region of the drumstick shaft provided with the light emitting diode, to which at least one optical fiber is coupled, which is guided to an outlet opening in the drumstick head or to an outlet opening at the end of the drumstick opposite to the drumstick head.

5. Drumstick according to claim 1, wherein the connecting wires are connected to a power supply unit and, if appropriate, to electronic components, that are arranged in the grip area of the drumstick shaft and with a connector and/or a switching element, which is arranged at the end of the drumstick shaft.

6. Drumstick according to claim 1, wherein the printed circuit board and at least the recess provided in the first wooden shell have at least approximately the same cross-section, wherein the first part of the recess arranged in the grip area, into which the part of the circuit is embedded, which comprises the power supply unit and, if appropriate, electronic components, is larger by a multiple compared to the channel-like second part of the recess, in which the electrical wires or the optical fibers are guided.

7. Drumstick according to claim 1, wherein the drumstick head comprises a frontally directed conical outlet opening with an opening angle between 40° and 60°, which outlet opening, if appropriate, comprises a reflecting coating and which outlet opening, after the shells have been connected, is filled with a separately applied transparent filling material, which encloses the light emitting diode or the optical fiber at least on the front side.

8. Drumstick according to claim 1, wherein the circuit comprises a control unit with a processor and a control program, which control unit is connectable via a connector and electrical cable or via a radio interface, with a host computer or further drumsticks.

9. Drumstick according to claim 1, wherein the circuit comprises a control unit with a processor and a control program, which control unit is designed to control the light emitting diode in at least one mode of operation, in which a) signals can be emitted by the light emitting diode that define a clock; and/or
b) strokes that can be detected by an acceleration sensor which is connected to the control unit, are transferable to the host computer, and/or
c) light or individual colors can be controlled by the host computer, and can continuously, intermittently and/or according to a program flow be switched on or off.

10. Drumstick according to claim 1, wherein that the power supply unit can galvanically or inductively be coupled with a charging device, and, if appropriate, via a cable with the host computer, and/or that within the recess a generator is provided, which seizes and transforms mechanical energy, into electrical energy.

11. Method for manufacturing a drumstick for musical instruments, according to claim 1, which drumstick comprises a drumstick shaft and a drumstick head with an outlet opening, out of which the light of at least one light emitting diode provided in the drumstick can escape, wherein two shells are provided that are complementary to one another and aligned in parallel to the longitudinal axis of the drumstick, from which at least the first wooden shell is provided with a recess, into which a circuit is inserted, that serves for controlling the light emitting diode, which is located in the drumstick head, or which is located in the drumstick shaft and is coupled with at least one optical fiber that is guided to the outlet opening, and that both shells are glued to one another and on the high pressure pressed against one another and subsequently wrote in to be desired form.

12. Method according to claim 11, wherein the parts of the recess provided in the shells are filled with filling material, and the shells are glued under pressure and then turned, subsequently the surface of the light emitting diode that serves for emitting light is freed from the filling material as the outlet opening of the drumstick head is filled with a transparent epoxy resin.

13. Method according to claim 11, wherein the at least two shells, which are glued to one another, are brought into the desired form by means of a turning machine.

14. Method according to claim 11, wherein the circuit comprises a control unit with a processing and a control program, which control unit is connectable via a radio interface, with a host computer or further drumsticks to an interconnected wireless network, and that, after the network has been set up, synchronization signals are transferred from a terminal acting as master in the network to the other terminals or drumsticks and are optically signaled by means of the first or second light emitting diode that is arranged in the drumstick head and/or in the drumstick shaft.

* * * * *